US006012869A

United States Patent [19]

Braun

[11] Patent Number: 6,012,869

[45] Date of Patent: Jan. 11, 2000

[54] EXPANSION JOINT AND SEAL CONTAINING INTERSECTIONS

[76] Inventor: Frank Anton Braun, 119 Woodview Crescent, Kitchener, Canada, N2A 3E4

[21] Appl. No.: 09/047,366

[22] Filed: Mar. 25, 1998

[51] Int. Cl.[7] ..... E01C 11/04

[52] U.S. Cl. ..... 404/64; 404/65; 404/68

[58] Field of Search ..... 14/73.1; 404/47, 404/56, 64, 65, 67

[56] References Cited

U.S. PATENT DOCUMENTS

| | | | |
|---|---|---|---|
| 3,118,523 | 1/1964 | Girot . | |
| 3,426,658 | 2/1969 | Fredrickson | 404/65 |
| 3,981,601 | 9/1976 | Arai | 14/73.1 X |
| 4,111,583 | 9/1978 | Brady et al. | 14/73.1 X |
| 4,245,925 | 1/1981 | Pyle | 14/73.1 X |
| 4,374,442 | 2/1983 | Hein et al. | 14/73.1 |
| 4,774,795 | 10/1988 | Braun . | |

*Primary Examiner*—James A. Lisehora
*Attorney, Agent, or Firm*—Daryl W. Schurr

[57] ABSTRACT

An expansion joint and seal for an expansion joint for use in structures where the joint has an intersection uses a seal with a solid thick keel extending along a lower edge of a central portion in an area of the intersection. The keel commences in a transition area between a conventional seal and the intersection. The seal increases in depth as the intersection is approached until it reaches a maximum depth at a mid point of the intersection. The keel minimizes distortion from racking during expansion or contraction of the joint. The seal is shaped to enable debris to be easily removed.

36 Claims, 13 Drawing Sheets

EXPANSION JOINT AND SEAL CONTAINING INTERSECTIONS

BACKGROUND OF THE INVENTION

1. Field of the Invention

This invention relates to an expansion joint containing an intersection of two or more sections. More particularly, this invention relates to an expansion joint and a seal for an expansion joint containing an intersection.

2. Description of the Prior Art

Expansion joints are known and one type of expansion joint is described in Braun U.S. Pat. No. 4,774,795.

Designs of structures using expansion joints sometimes require the expansion joints to contain an intersection. Typically, the intersection is an L-shaped intersection, a T-shaped or a Y-shaped intersection, or a four way intersection that has four sections where the angles between each section are approximately 90°. Expansion joints containing intersections have not worked particularly well as each area of the expansion joint is subjected to different forces when the structure in which the joint is located expands or contracts. The combination of the forces on the expansion joint during an expansion phase sometimes causes the seal of the joint to rise above the road surface where the expansion joint is installed. On other occasions, the seal twists uncontrollably and the twisting unreasonably limits the degree of expansion that the seal can undergo without tearing. On still other occasions, the seal is pulled out of supports that are designed to hold the edges of the seal in place. Mitring is sometimes used to construct a seal containing an intersection. When mitring is used, the seal is weak along a line where the mitring has occurred.

The Moerk, Jr. U.S. Pat. No. 4,033,702 describes a joint assembly for sealing the gap between roadway slabs at curb and sidewalk portions where the assembly has a flexible sealing flap member. The Girot U.S. Pat. No. 3,118,523 describes a connecting element for expansion joints to be used at an intersection. Sometimes, seals of expansion joints containing intersections cannot be easily cleaned and debris builds up in the seal, causing the seal to fail prematurely. During a contraction phase, the joint closes on the seal, which is forced against the debris, sometimes tearing the seal or transmitting damaging stresses to the structure. With some previous expansion joints containing intersections, the seal can only withstand a small range of expansion or contraction.

SUMMARY OF THE INVENTION

It is a object of the present invention to provide a seal and expansion joint having an intersection that has a broad range of movement between contraction and expansion and can expand or contract without rising above the road surface and without significant racking and without tearing. It is a further object of the present invention to provide a seal that can be easily cleaned.

An expansion joint has at least a two-way intersection. The expansion joint has at least two sections connected at said intersection, said at least two sections extending in a different direction from one another. Each section of said expansion joint has a seal with two sides, each side of said seal being supported by supports. The seal has a V-shaped central portion, said central portion increasing in depth towards said intersection and having a maximum depth at a centre of said intersection. The V-shaped portion has means to control racking distortion extending longitudinally thereon, said sections each having an outer end.

A seal for an expansion joint for use with side supports has an intersection with at least two sections extending in a different direction from one another. The seal has two sides and each side is supported by supports. The seal has a V-shaped central portion, said central portion increasing in depth towards said intersection and having a maximum depth at a centre of said intersection. The V-shaped portion has means to control racking distortion extending longitudinally thereon, said sections each having an outer end.

DESCRIPTION OF A PREFERRED EMBODIMENT

Figure 1:
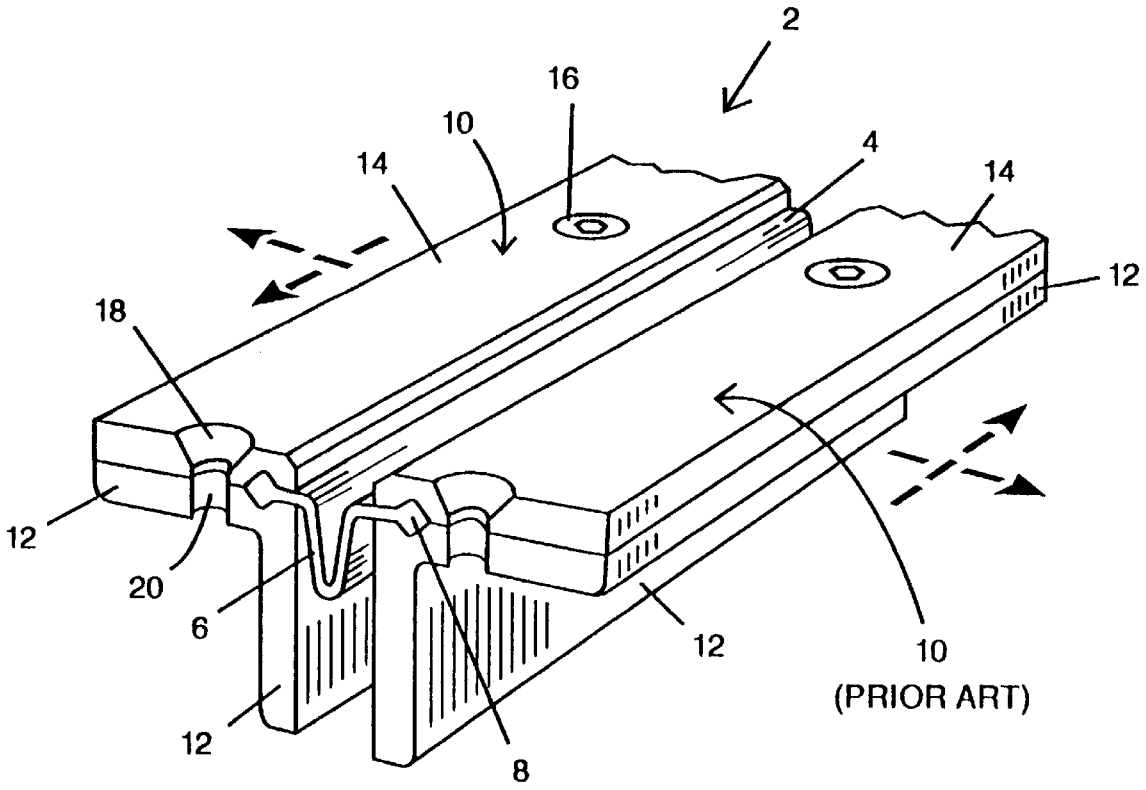
FIG. 1 is a perspective view of part of a prior art expansion joint having a seal held inside supports.

In FIG. 1, there is shown a prior art expansion joint 2. The expansion joint 2 has a seal 4 with a central portion 6. The seal 4 has two ridges 8 (one ridge along each side), each ridge is clamped within a cavity (not shown) within supports 10. The supports 10 each have a lower L-shaped bar 12 and an upper plate 14 that are held together by bolts 16 extending through openings 18, 20 in the upper plate 14 and lower bar 12 respectively. The arrows at each side indicate directions of movement. While the prior art expansion joint 2 has been used satisfactorily without mitring for two-way intersections having a gradual change in direction, it has been found that it does not perform satisfactorily if the change in direction is abrupt in that the seal either tears prematurely or rises up above the surface in which the expansion joint is installed when the joint is in an expansion or contraction mode, or the expansion joint does not expand over a broad enough range.

Figure 2:
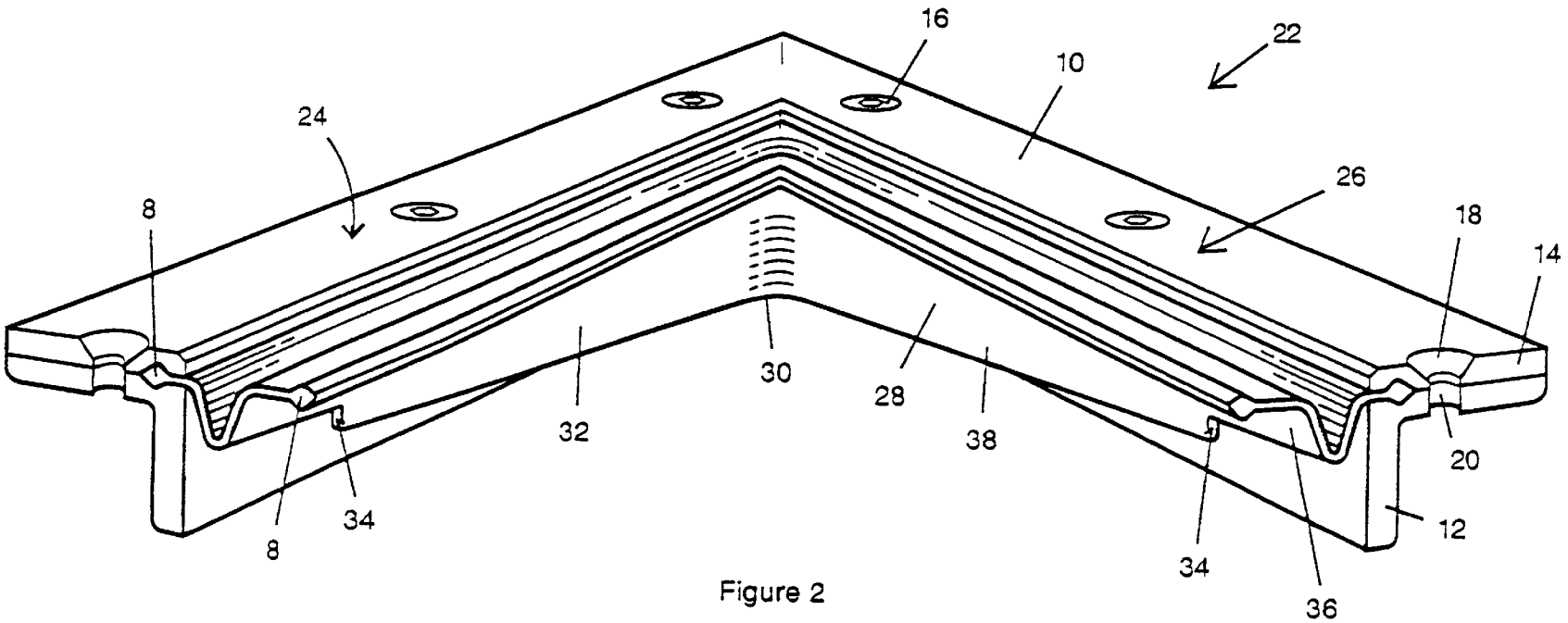
FIG. 2 is a perspective view of an expansion joint having two sections meeting at an intersection where part of a seal is contained within a support.

In FIG. 2, an expansion joint 22 has a two-way intersection with two sections, 24, 26. Those components of FIG. 2 that are identical to the components of FIG. 1 are described using the same reference numerals as used for FIG. 1. It can be seen that a seal 28 is held in a support 10 along an outer side. The support 10 has a lower bar 12 and upper plate 14 containing openings 20, 18 respectively for bolts 16. The support along the inner side of the seal 28 has been omitted for purposes of illustration. The seal 28 has ridges 8 along each side. The intersection has a central point 30 that represents a lowermost part of the seal 28. The seal 28 has a central portion 32 that increases in depth from an outer end 34 to the central point 30 of the intersection. An outer part 36 of the seal 28 that is beyond the part 34 has the same shape as the prior art seal 4 shown in FIG. 1. The lowermost portion of the seal 28 extending between the outer ends 34 and through the central point 30 is a solid keel 38.

Figure 3:
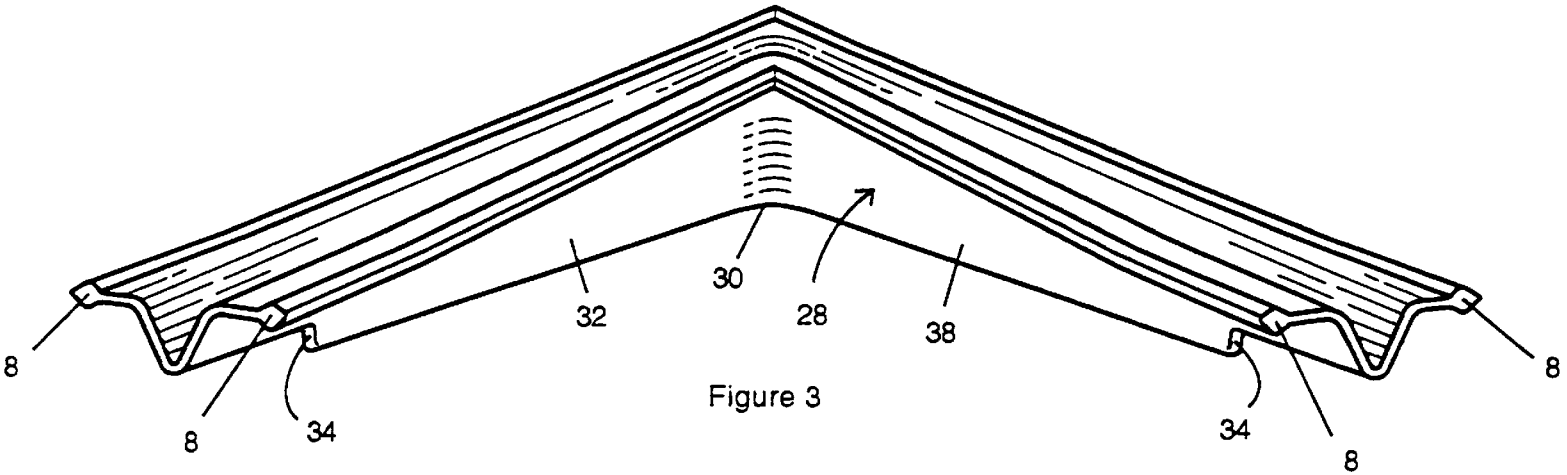
FIG. 3 is a perspective view of a seal having two sections meeting at an intersection.
Figure 4:
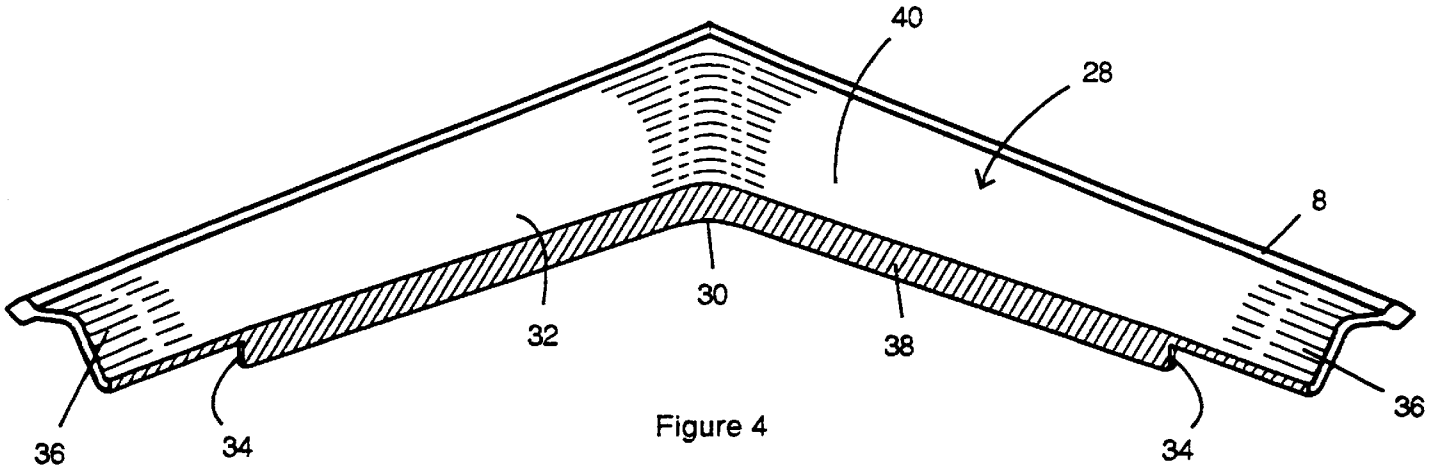
FIG. 4 is a perspective view of part of an L-shaped seal with a front portion cut away to expose an interior.

In FIG. 3, the same reference numerals are used for those components that are identical to those of FIG. 2. The seal 28 is shown with the support 10 removed. In FIG. 4, the seal 28 is shown with the front half of the seal cut away to expose an interior 40 of the seal 28. It can be seen that the keel 38 extending between the outer ends 34 and through the central point 30 is solid. It can also be seen that the keel 38 has a constant depth throughout but the central portion 32 of the seal 28 increases in depth toward the central point 30 at the intersection. In a variation of the embodiment shown, the seal 28 could be designed with the keel 38 increasing steadily in depth from each of the outer ends 34 to the central point 30 of the intersection.

The keel provides means to control racking distortion for the seal to prevent the seal from rising up above a road surface in which the expansion joint is located and to prevent the seal from rippling or twisting to such an extent that the life of the seal is significantly shortened. While it would be possible to locate means to control racking distortion on either side of the web of the central portion of the seal rather than along the lowermost part of the central portion as shown in the drawings, the location of the keel shown in the drawings is preferred. The means to control racking distortion is stiffening means. When located on either side of the web, at least two lengths of stiffening means are required and the two lengths should be identical in size, shape and location. When the keel is used as the stiffening means, only one length of stiffening means is required. If the stiffening means is located on either side of the central portion, it must be symmetrical about the lowermost portion. Preferably, the keel has a minimal width of twice the thickness of said seal in an area adjacent to said keel. Preferably, the keel has a depth of substantially three times the thickness of said seal in an area adjacent to said keel. While the seal is described in relation to intersections having two sections, three sections or four sections with the angles between these sections being as shown, expansion joints can be constructed in accordance with the present invention at various angles. The corners can have small radii as shown as long as the corners are rounded. Also, while the requirement would not be common, the expansion joint can have an intersection with more than four sections.

Figure 5:
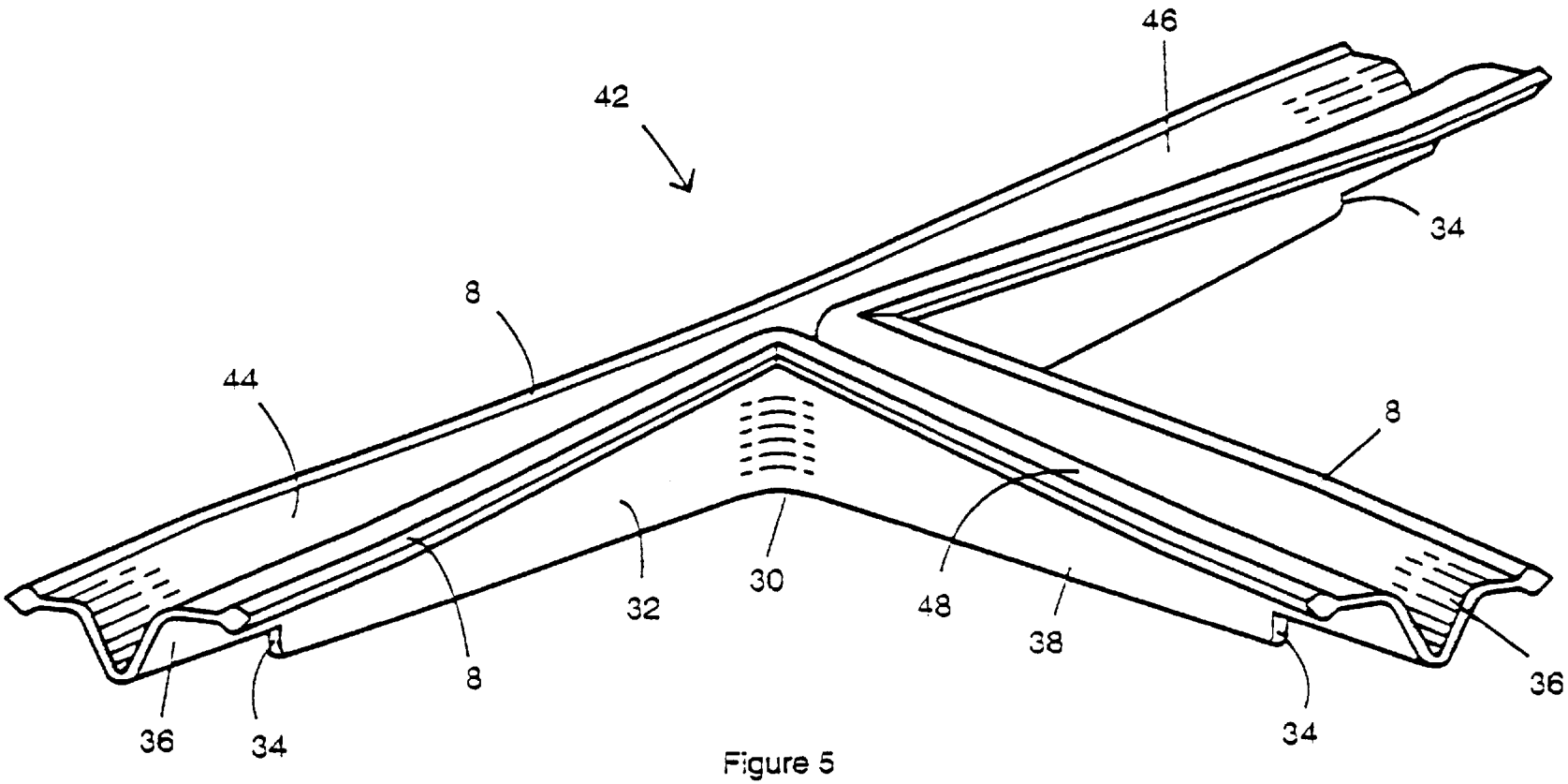
FIG. 5 is a perspective view of a seal for an expansion joint having a three-way T-shaped intersection.

In FIG. 5, there is shown a seal 42 having an intersection 44, 46, 48. The seal has a T-shape. The supports have been omitted and the components of the seal that are identical to the components of the seal 28 of FIG. 4 are described using the same reference numerals as those used for FIG. 4.

Figure 6:
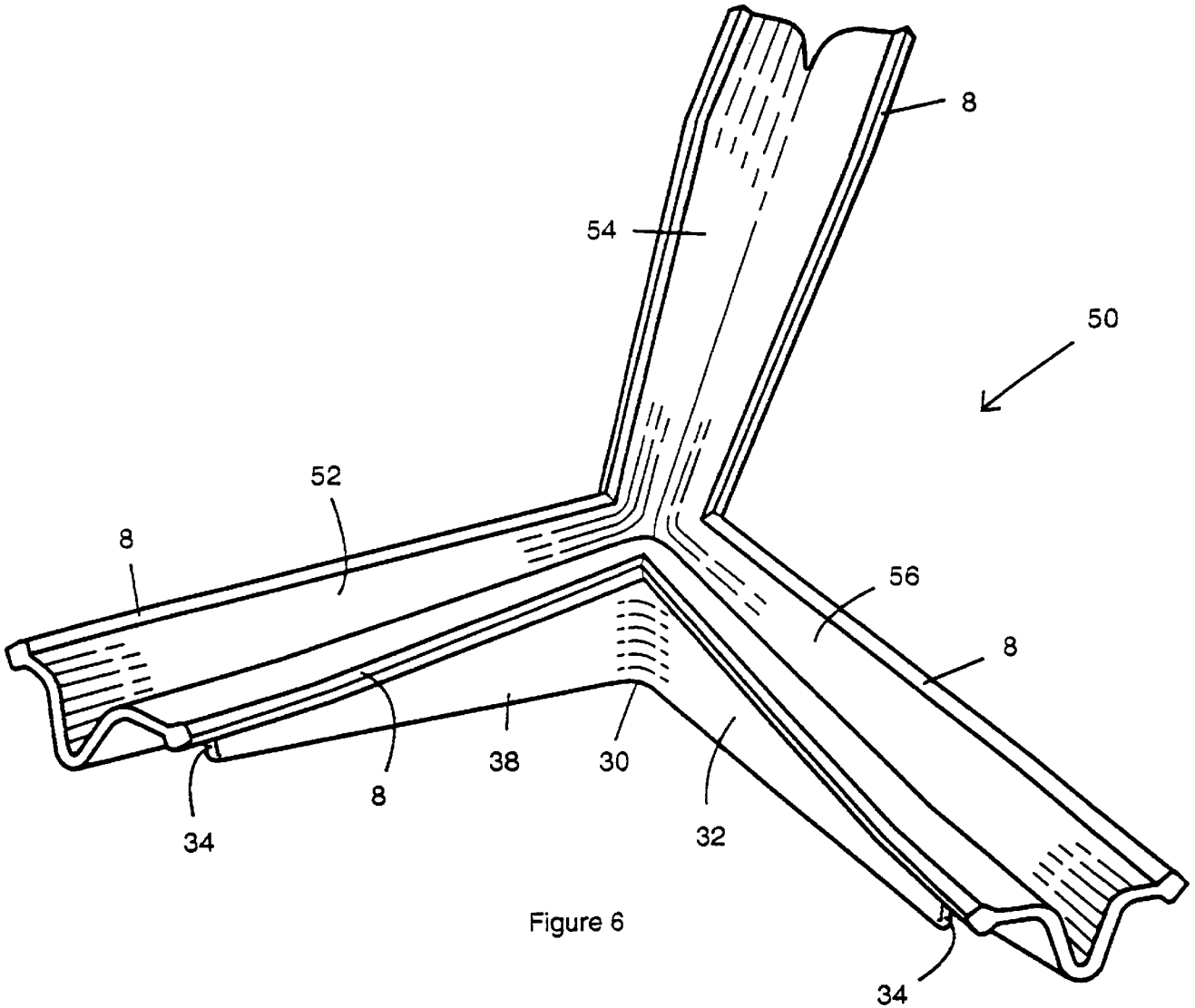
FIG. 6 is a perspective view of a seal for an expansion joint having a three-way Y-shaped intersection.

In FIG. 6, there is shown a seal 50 having an intersection with three sections 52, 54, 56. The supports have been omitted and the seal has a Y-shape. The components of the seal that are identical to the components of the seal 28 of FIG. 4 are described using the same reference numerals as those used for FIG. 4.

Figure 7:
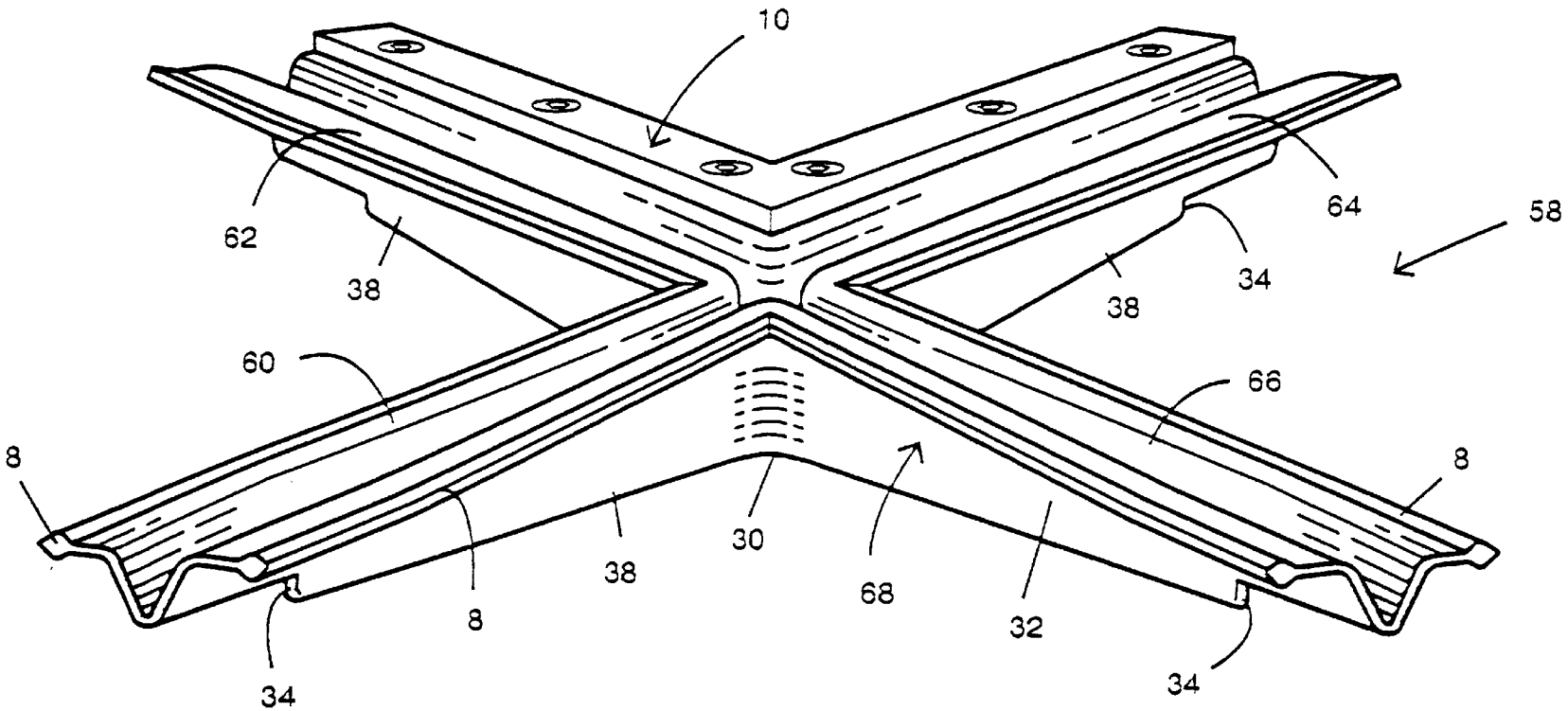
FIG. 7 is a perspective view of an expansion joint where part of a seal is contained within a support, said seal having four sections connected at an intersection.

In FIG. 7, there is shown a perspective view of an expansion joint 58 having four sections 60, 62, 64, 66. Supports 10 are shown on a rear portion of the joint 58, but the remaining supports on the remaining ridges have been omitted as they would obscure the seal from view. The expansion joint has a cross-shape with a seal 68. The components of the seal 68 that are identical to those of the seal 28 are described using the same reference numerals as those used for the seal 28 of FIG. 4.

Figure 8:
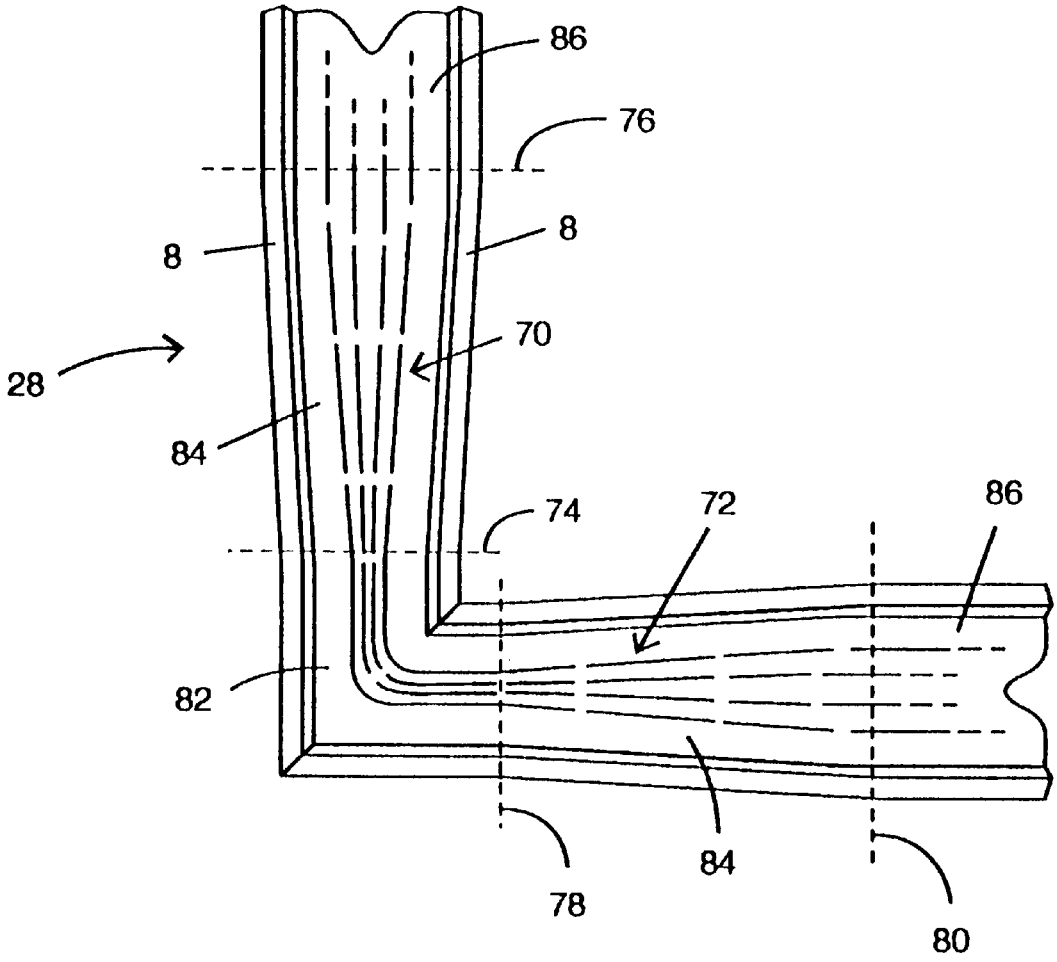
FIG. 8 is a top view of a two-way L-shaped intersection.

In FIG. 8, there is shown a schematic top view of the seal 28 having an intersection with two sections 70, 72. The section 70 has dotted lines 74, 76 extending laterally thereon and the section 72 has dotted lines 78, 80 extending laterally thereon. An intersection area 82 is located between the dotted lines 74, 78. It can be seen that outer sides of the seal 28 are parallel to one another in the area of the intersection area 82. Transition areas 84 are located between the dotted lines 74, 76 and between the dotted lines 78, 80. It can be seen that, in the transition areas 84, outer ridges 8 diverge from one another toward the outer end 34 (not shown in FIG. 8). Outer areas 86, beyond the dotted lines 76, 80 respectively have outer ridges that are parallel to one another. The seal in the two outer areas 86 can be, and preferably is, a conventional seal. Preferably, the outer end 34 (not shown in FIG. 8) of the keel 38 is located directly beneath the dotted lines 76, 80 for each section 70, 72 of the seal 28.

Figure 9:
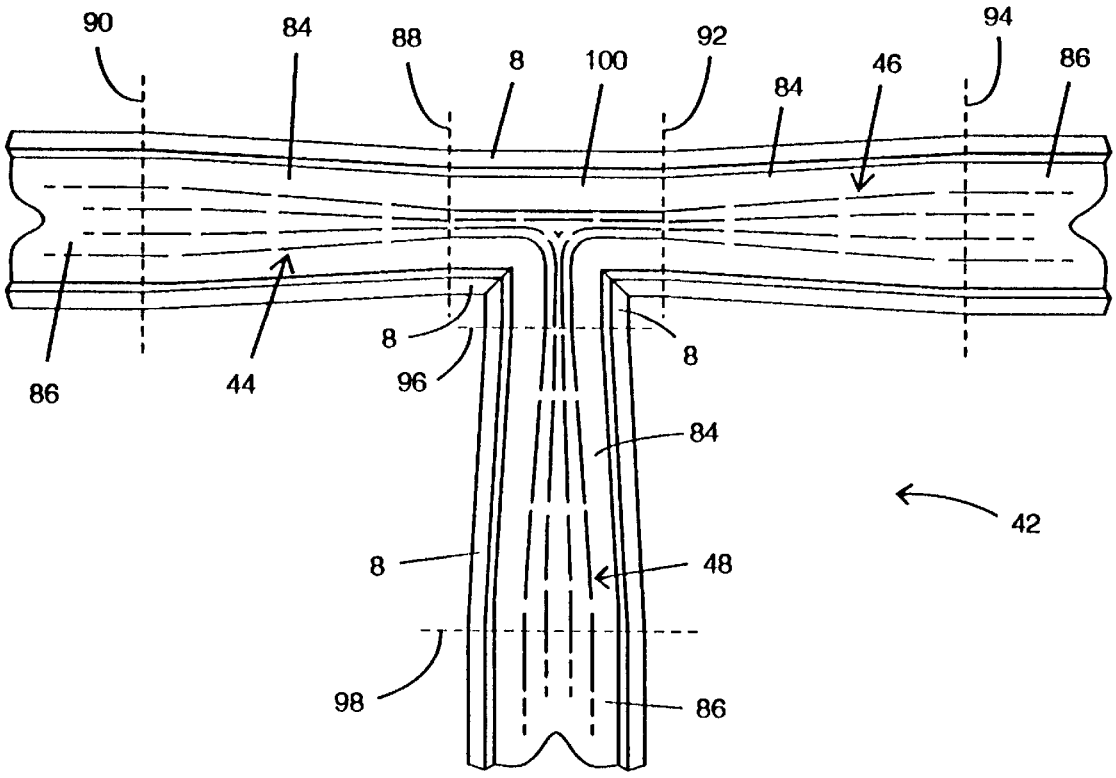
FIG. 9 is a top view of a three-way T-shaped intersection.

In FIG. 9, there is shown a schematic top view of the seal 42 having an intersection with three sections 44, 46, 48. Dotted lines 88, 90 extend laterally across the section 44. Dotted lines 92, 94 extend laterally across the section 46 and dotted lines 96, 98 extend laterally across the section 48. An intersection area 100 is located between the dotted lines 88, 92, 96. The ridges 8 in the intersection area 100 are parallel to one another. Three transition areas 84 extend between the dotted lines 88, 90, the dotted lines 92, 94 and the dotted lines 96, 98. The outer areas 86 of FIG. 9 are identical to the outer areas 86 of FIG. 8. The transition areas 84 of FIG. 9 are identical to the transition areas 84 of FIG. 8. Outer areas 86 are located beyond each of the dotted lines 90, 94, 98, away from the intersection area 100.

Figure 10:
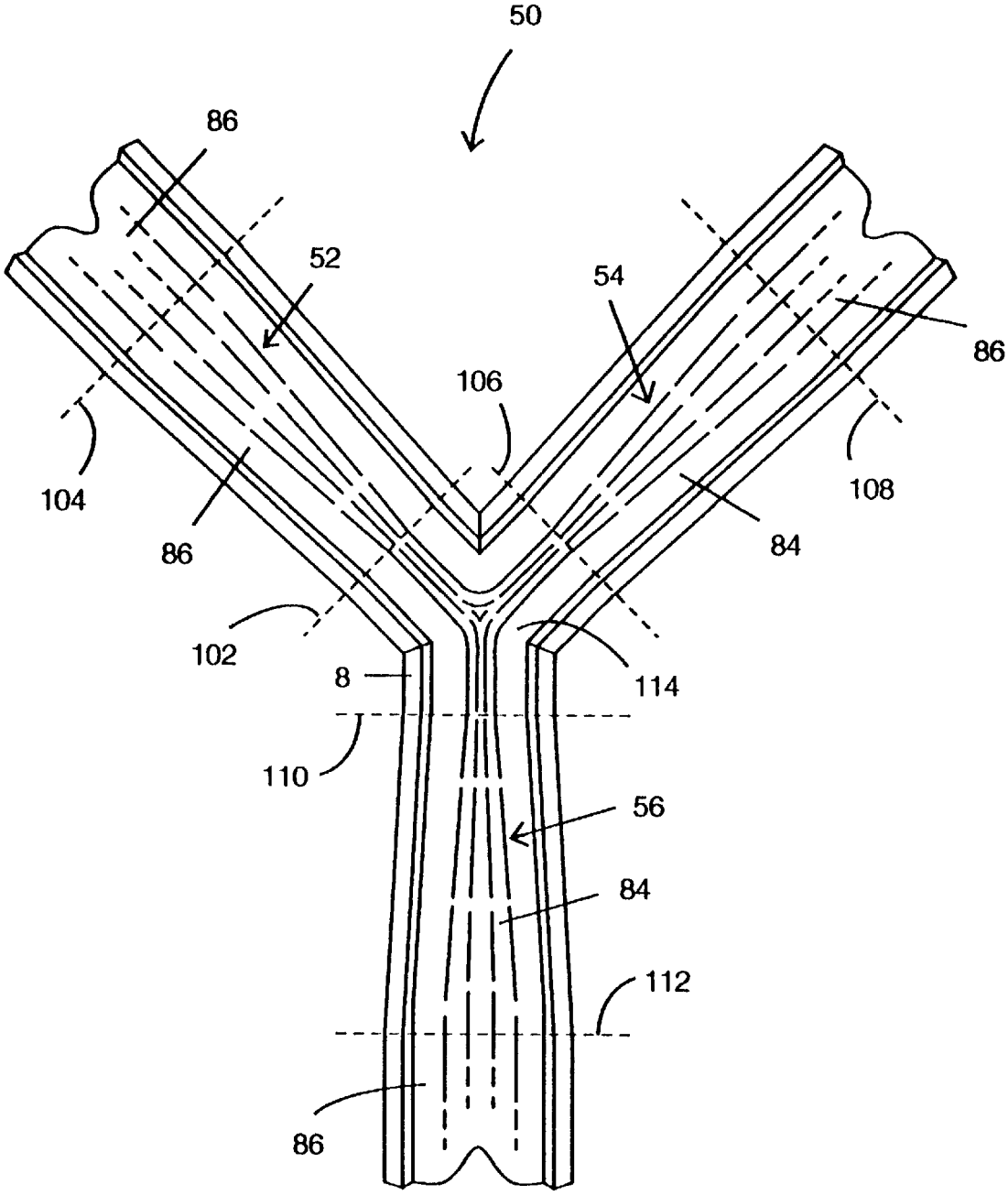
FIG. 10 is a top view of a Y-shaped three-way intersection.

FIG. 10 is a schematic top view of the seal 50 having three sections 52, 54, 56 arranged in a Y-shape. Section 52 has lateral dotted lines 102, 104 thereon. Section 54 has lateral dotted lines 106, 108 and section 56 has lateral dotted lines 110, 112. An intersection area 114 is located between the dotted lines 102, 106 and 110 of the three sections. The ridges 8 on either side of the seal in the intersection area 114 are parallel to one another. In other words, a cross sectional width of the seal is constant in the intersection area 114. Transitional areas 84 are located between the dotted lines 102, 104, the dotted lines 106, 108 and the dotted lines 110, 112. The transitional areas 84 are identical to the transitional areas 84 of FIG. 8. Outside areas 86 are located beyond each of the dotted lines 104, 108, 112 away from the intersection area 114.

Figure 11:
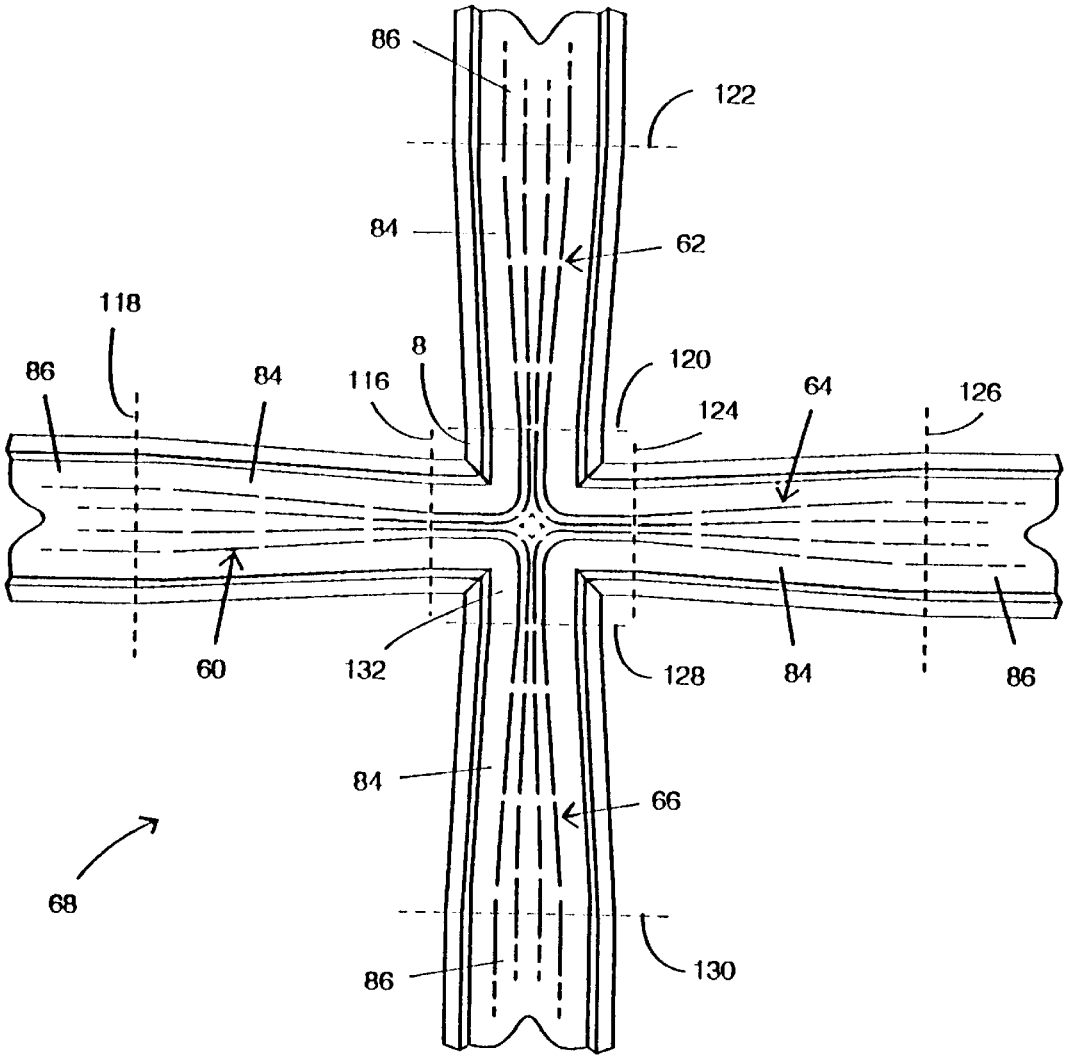
FIG. 11 is a top view of a four-way intersection where the angle between adjacent sections is approximately 90°.

FIG. 11 is a schematic top view of the seal 68 having four sections 60, 62, 64, 66. Section 60 has lateral dotted lines 116, 118 thereon and section 62 has dotted lines 120, 122 thereon. Section 64 has dotted lines 124, 126 thereon and section 66 has lateral dotted lines 128, 130 thereon. An intersection area 132 is located between the dotted lines 116, 120, 124, 128. Ridges 8 in the intersection area 132 on either side of the seal 68 are parallel to one another. Transition areas 84 are located between the dotted lines 116, 118, the dotted lines 120, 122, the dotted lines 124, 126 and the dotted lines 128, 130. Outer areas 86 are located beyond each of the dotted lines 118, 122, 126, 130. The transition areas 84 and the outer areas 86 are identical to those of FIG. 8.

Figure 12:
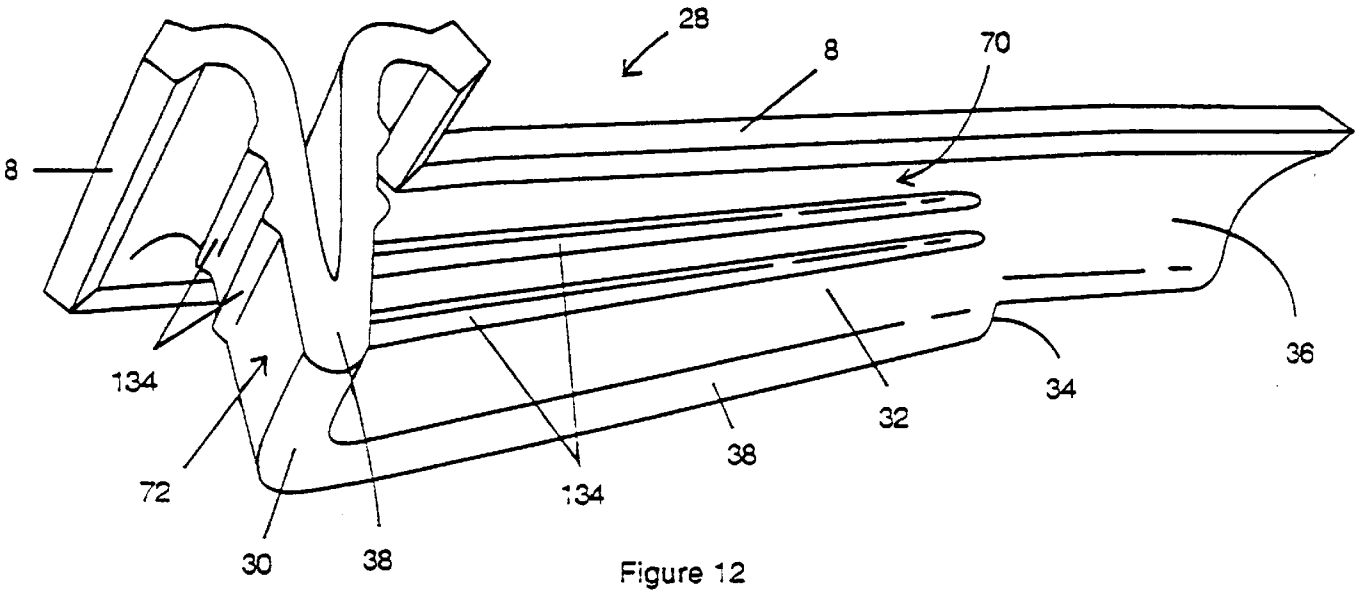
FIG. 12 is a perspective view of part of an L-shaped seal where a side of a central portion has longitudinal ribs thereon.

FIG. 12 is a perspective view of part of the seal 28 having sections 70, 72. The section 72 has been truncated so it does not hide the view of section 70. Extending along each of the outer sides of the central portion 32 are two horizontal ribs 134. The ribs 134 add further stiffening means to the seal 28. While the ribs 134 are only shown on the L-shaped seal, they could be used on any seal of the present invention. While there are two horizontal ribs 134 shown on each side of the seal, there could be more than two ribs on each side or there could be one rib on each side. Also, the ribs could be larger or smaller than the ribs shown in FIG. 12. Further, the ribs could have virtually any reasonable shape. For example, the ribs could have a rectangular shape, a semi-circular shape, a diamond shape or an ovular shape. Those components that are identical to the components of FIGS. 3 and 8 are described using the same reference numerals.

Figure 13:
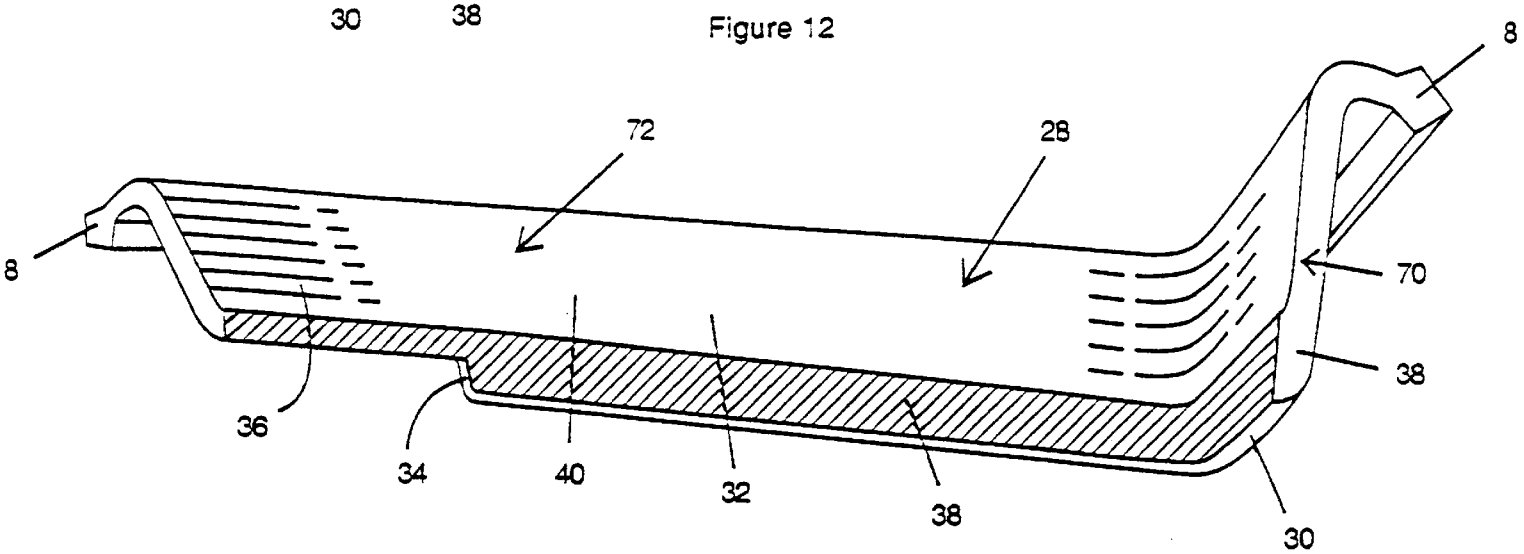
FIG. 13 is a perspective view of part of an L-shaped seal where a front portion is cut away to expose an interior.

FIG. 13 is a perspective view of the L-shaped seal 28 having sections 70, 72 where the section 70 is truncated for ease of illustration and a front portion of the seal 28 has been cut away to expose the interior 40. The keel 38 is shown as having a constant depth. It can be seen that the depth of the seal increases toward the central point 30 of the intersection. From both FIGS. 12 and 13, it can be seen that the seal is rounded at the keel 38. The same reference numerals are used in FIG. 13 for those components that are identical to the components of FIGS. 3 and 8.

Figure 14:
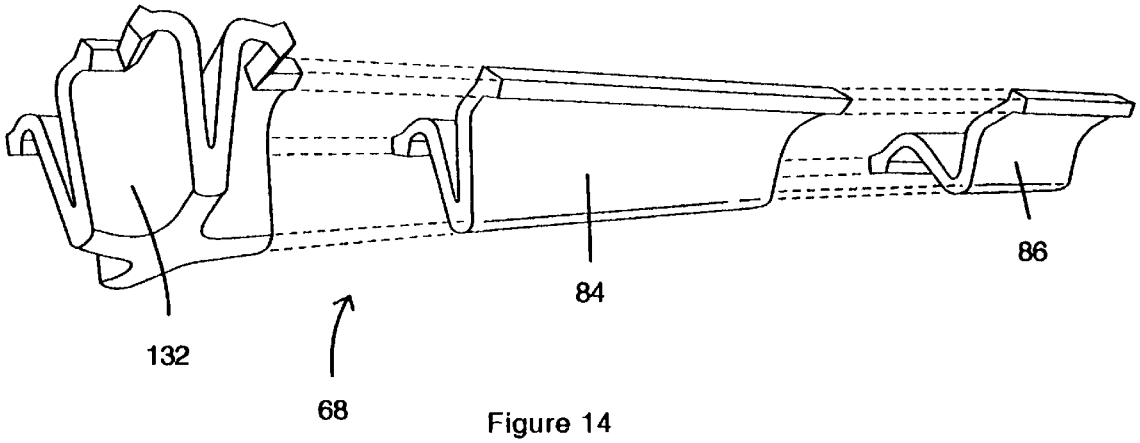
FIG. 14 is an exploded perspective view of part of a seal having a four-way intersection.

FIG. 14 is an exploded perspective view of part of the seal 68 with the intersection area 132, one transition area 84 and one outer area 86. Those components that are identical to components of FIG. 11 are described using the same reference numerals. In place of the intersection area 132, the intersection areas 114, 100 or 82 of FIGS. 10, 9 and 8 respectively could be used with appropriate transition areas 84 and outer areas 86. In addition, different intersection areas can be used from those shown in the drawings. In other words, the angles between two sections could be something other than substantially 90° or substantially 120° depending on the structure in which the expansion joint is intended to be used. In FIG. 14, the transition area and outer area is shown for only one section and these components would be located on all of the sections of the intersection area.

Figure 15:
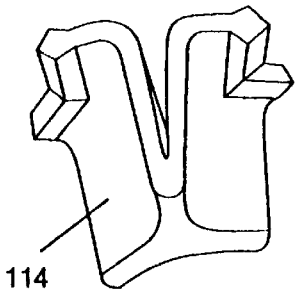
FIG. 15 is a perspective view of a three-way Y-shaped intersection area.
Figure 16:
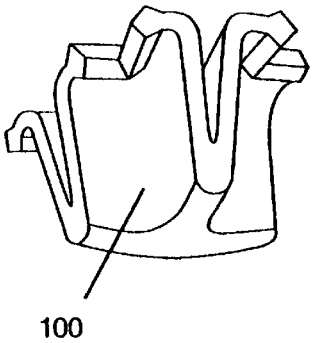
FIG. 16 is a perspective view of a three way T-shaped intersection area.
Figure 17:
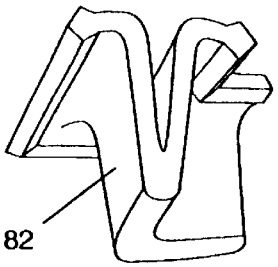
FIG. 17 is a perspective view of a two-way L-shaped intersection area.

In FIG. 15 there is shown a perspective view of the intersection area 114 for a Y-shaped three-way intersection. In FIG. 16, there is shown a perspective view of the intersection area 100 for a T-shaped three-way intersection. In FIG. 17, there is shown a perspective view of the intersection area for a two-way L-shaped intersection. The intersection areas 114, 100, 82 can be substituted in turn, as deprived, for the intersection area 132 in FIG. 14. The transition area 84 and the outer areas 86 would remain the same, but, of course, the number of sections would change with the appropriate number required for the intersection area being used. In this way, different seals can be created simply by substituting different intersection areas. The same mold can be used for all of the transition areas and a different mold can be used for all the outer areas. The seals in the outer areas will usually extend well beyond that shown in the drawings. The different areas are preferably attached to one another by vulcanizing them together.

Preferably, an interior depth of a seal at the point 30 is equal to or greater than a factor of 1.2 times an interior depth at an outer end 34 where the keel commences of the transition area 84.

Figure 18:
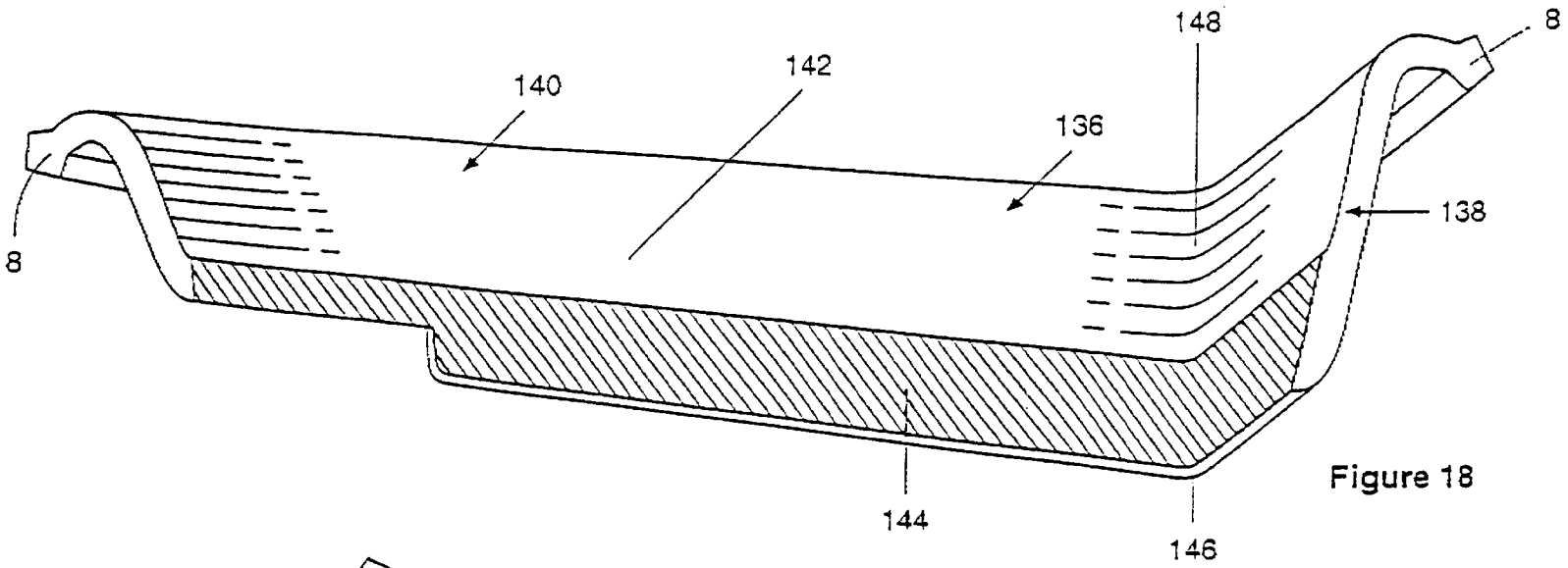
FIG. 18 is a perspective view of an L-shaped seal having a keel that increases in thickness toward said intersection.
Figure 19:
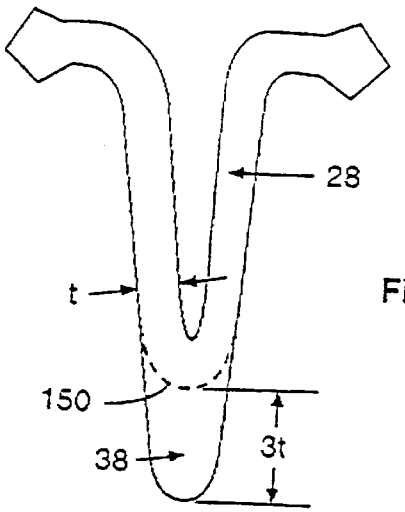
FIG. 19 is a schematic sectional view of a seal

In FIG. 18, there is shown a perspective view of an L-shaped seal 136 having sections 138, 140 where the Section 138 is truncated for ease of illustration and a front portion of the seal 136 has been cut away to expose an interior 142. In can be seen that a keel 144, only half of which is shown, has a depth that increases toward a central point 146 of an intersection 148. The seal has ridges 8 along each side (only one of which is shown). In FIG. 19, dimensions t and 3t are shown on a schematic sectional view of a seal 28 having a keel 38. It can be seen that a keel 38 has thickness 3t that is substantially 3 times the thickness t of said seal 28 in an area adjacent to said keel.

The ridges 8 of all of the seals shown on the drawings have a square or diamond-shaped cross-section. The shape of these ridges is preferably the shape shown in the drawings, but other shapes that can be clamped into supports could also be used. From FIGS. 4 and 13, it can be seen that the interior surface has a gentle slope and there are no abrupt changes in depth that would make the seal difficult to clean. Debris in the seal can be easily removed. The expansion joints of the present invention are designed to be used in structures such as bridges and parking garages that are subjected to vehicular traffic. It is important in these structures that the seal never rises above the travelled surface in which the expansion joint is installed. If the seal does rise about the travelled surface, the seal will very likely fail prematurely as it will be subjected to abrasion as each motor vehicle wheel passes over the expansion joint.

I claim:

1. An expansion joint for use in structures where movement at said joint occurs in more than one direction, said expansion joint comprising at least two sections connected at an intersection, said at least two sections extending in a different direction from one another, said expansion joint having a seal with two sides, each side of said seal being supported by supports, said seal having a V-shaped central portion, said central portion increasing in depth toward said intersection and having a maximum depth at a centre of said intersection, said V-shaped portion having means to control racking distortion extending longitudinally thereon, said means to control racked distortion being a substantial thickening of said seal, said sections each having an outer end.

2. An expansion joint as claimed in claim 1 wherein said means to control racking distortion is a thickened keel extending along a base of said central portion.

3. An expansion joint as claimed in claim 2 wherein said keel has a minimum depth of twice a thickness of said seal in an area adjacent to said keel.

4. An expansion joint as claimed in claim 3 wherein the keel has a thickness of substantially three times the thickness of said seal in an area adjacent to said keel.

5. An expansion joint as claimed in claim 4 wherein said keel increases in thickness toward said intersection.

6. An expansion joint as claimed in claim 5 wherein each section has a transitional area extending from an outer end toward said intersection, said transitional area having a smoothly converging width toward said intersection.

7. An expansion joint as claimed in claim 6 wherein the joint has an intersection area that includes said intersection, said intersection area being connected to said transitional area for each section, a width of said seal in said intersection area being constant.

8. An expansion joint as claimed in any one of claims 1 or 7 wherein said central portion has two sides and there is at least one ridge extending longitudinally on each side of said seal.

9. An expansion joint as claimed in claim 8 wherein there are at least two ridges extending along each of said sides.

10. An expansion joint as claimed in claim 9 wherein said ridges have a shape selected from the group of rectangular, arc-shaped, diamond-shaped, triangular and hexagonal.

11. An expansion joint as claimed in any one of claims 1, 2 or 3 wherein the joint has two sections and is L-shaped.

12. An expansion joint as claimed in any one of claims 1, 2 or 3 wherein the joint has three sections and is Y-shaped.

13. An expansion joint as claimed in any one of claims 1, 2 or 3 wherein the joint has four sections and is X-shaped.

14. An expansion joint as claimed in any one of claims 1, 2 or 3 wherein the joint has four sections that are substantially 90° apart from one another.

15. An expansion joint as claimed in any one of claims 1, 2 or 3 wherein the joint has three sections and is T-shaped.

16. An expansion joint as claimed in any one of claims 1, 2 or 3 wherein an interior depth of said seal at a point of intersection is at least 20% deeper than an interior depth of said seal at a point away from said intersection where said means to control racking terminates.

17. An expansion joint as claimed in claim 2 wherein said central portion smoothly increases in depth toward said intersection.

18. An expansion joint as claimed in claim 17 wherein said seal increases rapidly in depth as said intersection is approached, said seal then increasing gradually in depth to a central point of said intersection.

19. An expansion joint as claimed in claim 18 wherein said seal has a plurality of substantially horizontal ribs thereon when said seal is in an upright position.

20. An expansion joint as claimed in claim 19 wherein there are at least two ridges, one ridge extending along each of said sides, said ridges being sized and shaped to fit within a cavity having a similar shape to one ridge, said cavity being located within said supports.

21. An expansion joint as claimed in claim 20 wherein said ridges have a shape selected from the group of rectangular, arc-shaped, diamond-shaped, triangular and hexagonal.

22. An expansion joint as claimed in claim 18 wherein said base is solid.

23. An expansion joint as claimed in claim 22 wherein said base has rounded corners.

24. An expansion joint as claimed in claim 18 wherein said seal is made from flexible elastomeric membrane and said base is solid.

25. An expansion joint as claimed in any one of claims 2 or 3 wherein the keel has a constant depth.

26. An expansion joint as claimed in claim 1 wherein said joint is at least a four-way intersection.

27. An expansion joint as claimed in claim 1 wherein said joint has a plurality of identical sections connected to an intersection area, said intersection area being selected from the group of a two-way, three-way, four-way or more than four-way intersection, the number of identical sections being appropriate for the intersection area being utilized.

28. An expansion joint as claimed in claim 1 wherein the joint has a number of sections selected from the group of two, three, four and greater than four.

29. A seal for an expansion joint for use with side supports, said seal comprising an intersection with at least two sections extending in a different direction from one another, said seal having two sides with each side being supported by supports, said seal having a V-shaped central portion, said central portion increasing in depth toward said intersection and having a maximum depth at a centre of said intersection, said V-shaped portion having means to control racking distortion extending longitudinally thereon, said means to control racking distortion being of substantial thickening of said seal, said sections each having an outer end.

30. A seal as claimed in claim 29 wherein said means to control racking distortion is a thickened keel extending along a base of said central portion.

31. A seal as claimed in claim 30 wherein the keel has a minimum depth of twice the thickness of said seal in an area adjacent to said keel.

32. A seal as claimed in claim 31 wherein the keel has a thickness of substantially three times the thickness of said seal in an area adjacent to said keel.

33. A seal as claimed in any one of claims 29, 30 or 31 wherein an interior depth of said seal at a point of intersection is at least 20% greater than an interior depth of said seal at a point away from said intersection where said means to control racking terminates.

34. A seal as claimed in any one of claims 29, 30 or 31 wherein the seal has a number of sections selected from the group of two, three, four and greater than four.

35. A seal as claimed in any one of claims 29, 30 or 31 wherein said seal has a plurality of substantially horizontal ribs thereon once said seal is in an upright position.

36. A seal as claimed in any one of claims 29, 30 or 31 wherein the seal has a plurality of identical sections connected to an intersection area, said intersection area being selected from the group of a two-way, three-way, four-way or more than four-way intersection, the number of identical sections being appropriate for the intersection being utilized.

* * * * *